United States Patent [19]

Walon

[11] 4,040,861

[45] Aug. 9, 1977

[54] PROCESS OF REFINING ENZYMATICALLY PRODUCED LEVULOSE SYRUPS

[75] Inventor: Raoul G. P. Walon, Brussels, Belgium

[73] Assignee: CPC International Inc., Englewood Cliffs, N.J.

[21] Appl. No.: 721,741

[22] Filed: Sept. 9, 1976

[30] Foreign Application Priority Data

Mar. 15, 1976 Belgium ..... 54881

[51] Int. Cl.[2] ..... C13D 3/12; C13D 3/14; C13K 11/00

[52] U.S. Cl. ..... 127/46 A; 127/55; 195/31 F

[58] Field of Search ..... 127/46 A, 55, 4 GR; 195/31 F

[56] References Cited

U.S. PATENT DOCUMENTS

| | | | |
|---|---|---|---|
| 2,221,683 | 11/1940 | Smit | 127/46 A |
| 3,383,245 | 5/1968 | Scallet | 127/46 R |
| 3,475,216 | 10/1969 | Walon | 127/46 R |
| 3,684,574 | 8/1972 | Katz | 127/46 A |
| 3,834,940 | 9/1974 | Khaleeluddin | 127/46 A |

*Primary Examiner*—Sidney Marantz

*Attorney, Agent, or Firm*—Janet E. Price; Donald G. Marion

[57] ABSTRACT

Refining process for removing impurities from enzymatically produced levulose syrups comprises treating the syrups with a strong acid cation exchange resin, a weak base anion exchange resin, and sulfonated coal which has decolorizing ability. The process yields syrups of exceptional purity and stability.

10 Claims, No Drawings

PROCESS OF REFINING ENZYMATICALLY PRODUCED LEVULOSE SYRUPS

This invention relates to an improved process for refining enzymatically produced levulose-bearing syrups. By the term "enzymatically produced levulose-bearing syrups" is meant syrups which are prepared by isomerizing at least a portion of the dextrose in a dextrose-containing solution (said dextrose-containing solution having been obtained by the hydrolysis of starch) to levulose by means of an appropriate glucose isomerase enzyme preparation. The enzymatic method of isomerizing dextrose to levulose to prepare levulose-bearing syrups has, within recent years, assumed substantial commercial importance. Suitable processes for the enzymatic isomerization of dextrose to levulose are disclosed, for example, in U.S. Pat. No. 3,813,318 to Armbruster et al. (issued May 28, 1974,) U.S. Pat. No. 3,868,304 to Messing (issued Feb. 25, 1975) and U.S. Pat. No. 3,910,821 to Cory (issued Oct. 7, 1975).

During the enzymatic isomerization process various by-products, color bodies, color percursors, and other impurities are formed which must, naturally, be removed from the final product. The most conventional refining process for these syrups (as well as for virtually all starch hydrolyzate syrups, for that matter) involves treatment with cation exchange resins, anion exchange resins and activated carbon, the activated carbon being the principal decolorizing agent in the refining process. See, for example, U.S. Pat. Nos. 3,834,940 and 3,784,409. It has been noted that levulose develops more color during storage, and has in general a higher reactivity, than other starch-derived sugar products such as dextrose, glucose syrups, and the like. Therefore, it is desirable to develop an improved refining process for levulose-bearing syrups which will remove, in an economical manner, the maximum amount of color percursors and other impurities which are responsible for the color instability and reactivity, during storage, of the syrups.

Sulfonated coal has been used in the past in the refining of sugar syrups such as sucrose syrups, glucose syrups, dextrose, etc., see for example, U.S. Pat. No. 2,221,683. It is prepared by treating a finely divided carbonaceous material such as coal with sulphuric acid, as is disclosed in U.S. Pat. Nos. 2,171,408 and 2,191,063 to Smit. It is readily available on the market, one suitable product being sold by Akzo Chemie Verkoopkantoor by Imati, Amsterdam, the Netherlands, under the trade mark "Dusarit S". Sulfonated coal has both cation exchange properties plus, if it is regenerated first with alkali and then with acid, decolorizing properties.

It is common practice to refine sugar syrups with anion and cation exchange resins to remove ions therefrom, and sulfonated coal is frequently employed as a cation exchange resin in such processes. See, for example, U.S. Pat. Nos. 2,388,194 (sucrose refining) 2,680,082 (dextrose refining) and 3,475,216 (refining a levulose-containing syrup).

I have made the surprising discovery that, in the refining of enzymatically isomerized levulose-containing syrups a system comprising sulfonated coal in conjunction with ion exchange resins is vastly superior, in terms of removal of color, color percursors and other undesirable impurities, and also in terms of overall efficiency and economy, than the conventional systems employing activated carbon as the decolorizing agent. Although sulfonated coal is known as a decolorizing agent, its extraordinary efficacity in conjunction with ion exchange resins, in the refining of enzymatically produced levulose syrups could not be predicted from the known prior art.

In accordance with the process of the invention, an enzymatically isomerized levulose-bearing syrup is refined by treating it with a strong acid cation exchange for the removal of cations, a weak base anion exchanger for the removal of anions, and sulfonated coal for the removal of color bodies and color percursors. The ion exchange and sulfonated coal treatments can be performed in any order, but the preferred order is (1) cation exchange, (2) sulfonated coal, (3) anion exchange. When the refining process is performed in this particular order the removal of color bodies and other impurities by the sulfonated coal protects the anion exchanger from fouling and therefore greatly extends the life of the anion exchange resin.

Sulfonated coal has cation exchange properties and, if it is regenerated with acid alone, will retain only these cation exchange properties and will not have, in addition, the decolorizing ability necessary for its use in the instant invention. As has been mentioned previously, the necessary decolorizing ability is obtained if the sulfonated coal is regenerated by first treating with a strong alkali (such as sodium hydroxide) and then (preferably after an intermediate washing with water) treating with the strong acid.

Following is a detailed description of a suitable process for regenerating the sulfonated coal in order to impart to it the necessary decolorizing ability. First, the sulfonated coal (contained in a column) is washed with water in order to eliminate any sugar residues; next it is "back-washed", i.e. given a countercurrent wash, to remove any remaining impurities such as dust, sludge, or the like. The next step is the regeneration with alkali. This can advantageously be performed by passing a 1% to 3% solution of sodium hydroxide (or other strong alkali) through the column, in an amount of about 2 bed volumes at a rate of ½ bed volume to 1 bed volume per hour at a temperature of about 50° C to 60° C. At the end of the alkali regeneration the pH is, of course, quite high, and therefore it is desirable to wash the column with water to reduce the pH to about 7 to 9. Next comes the conventional acid regeneration, for example by adding one bed volume of 6% to 10% HCl at a rate of about 1 bed volume per hour. Finally, the sulfonated coal is washed for removal of acid.

As has been mentioned previously, and as will be readily seen from the examples, the process of the invention is far more efficient, and results in purer and more stable levulose-bearing products, than the conventional refining processes. Furthermore, increased efficiency, purity, and stability can be obtained by the use of a small amount of activated carbon in addition to the ion exchange-sulfonated coal treatment. This will be illustrated in Example I.

The following examples will illustrate more fully the practice of the invention, but should not be construed as limiting the invention as claimed. In the examples, unless otherwise specified, all percentages are by weight, dry basis. In the examples the "original color" was determined by measuring the absorbance of a diluted liquor in a 4 cm. cell at 450 mu and 600 mu on a Beckman spectrophotometer and calculating in accordance with the formula $$\text{color} = \frac{(A450\text{-}A600) \times 100}{cd}$$

wherein $d$ = length of the cell, $c$ = concentration in g./100 ml and $A$ = absorbance. The "heat color", which indicates the storage stability and therefore the removal of color percursors, was determined by holding the liquor at pH 4.8, in a waterbath at 100° C for 1 hour, cooling to room temperature, diluting to 30% dry substance, and measuring the color in the manner previously described.

EXAMPLE I

The starting material was an enzymatically produced levulose syrup having the following composition:

| | |
|---|---|
| Levulose | 41% |
| Dextrose | 52% |
| Maltose | 2% |
| Tri- and higher saccharides | 5% |
| Original color | 1.9 |
| Heat color | 7.1 |

Portions of this syrup were refined by the following processes (the sulfonated coal and activated carbon, in addition to the ion exchange resins, being positioned in columns): A. (Conventional, for comparison purposes) (1) Cation exchange resin (C16P, by Imacti), (2) Anion exchange resin (Lewatit MP62, By Bayer A.G. 509 Leverkusen - Bayerwerk, Germany), and (3) Activated carbon in an amount of 1% d.s., based on the weight of the syrup dry basis; B. (In accordance with the invention) (1) Cation exchange resin (C16P), (2) Sulfonated coal (Dusarit S, by Imacti) (3) Anion exchange resin (MP62); C. (In accordance with the invention) Identical with B., plus, after the anion exchanger, activated carbon in an amount of 0.5% d.s.

Samples were taken from every tenth bed volume (BV). Original color and heat color of each of the samples were measured. The results are tabulated in table I.

TABLE I

| After | 10 BV | 20 BV | 30 BV | 40 BV | 50 BV | 60 BV |
|---|---|---|---|---|---|---|
| A. (control) cation exchanger + anion exchanger + 1% d.s. active carbon | | | | | | |
| original color | 1.0 | 1.2 | 1.3 | | | |
| heat color | 1.4 | 2.1 | 3.2 | | | |
| B. cation exchanger + sulfonated coal + anion exchanger | | | | | | |
| original color | 0.5 | 0.6 | 0.7 | 0.7 | 1.0 | |
| heat color | 1.2 | 1.4 | 1.7 | 1.9 | 2.0 | |
| C. cation exchanger + sulfonated coal + anion exchanger + active carbon | | | | | | |
| original color | 0.2 | 0.3 | 0.3 | 0.3 | 0.3 | 0.4 |
| heat color | 0.5 | 0.6 | 0.6 | 0.6 | 0.7 | 0.7 |

The data in Table I show the following remarkable improvements resulting from the process of the invention, as compared to conventional refining.

1. Reduction in original color and improved color stability, after the same number of bed volumes.

2. Far better efficiency of operation, in that the process of the invention can be conducted through more than 50 bed volumes before it becomes necessary to regenerate the refining system, while regeneration of the conventional system should take place after 30 bed volumes.

3. Run C shows that exceptional efficiency and extraordinarily heat stable products result from using a small amount of activated carbon in addition to the sulfonated coal (heat color of only 0.7 after 60 bed volumes.)

EXAMPLE II

An enzymatically produced levulose syrup of lower original color and heat color than that of Example I was used. It had the following composition:

| | |
|---|---|
| D.E. | 84 |
| Levulose | 38% |
| Dextrose | 37% |
| Maltose | 15% |
| Tri- and higher saccharides | 15% |
| Original color | 1.2 |
| Heat color | 6.2 |

Portions of this syrup were refined and evaluated as in runs A (control) and B (invention) of Example I. The results are tabulated in Table II.

TABLE II

| After | 10 BV | 20 BV | 30 BV | 40 BV | 50 BV | 60 BV |
|---|---|---|---|---|---|---|
| A. (control) cation exchanger + anion exchanger + 1% active carbon | | | | | | |
| original color | 0.8 | 0.9 | 1.0 | 1.1 | 1.9 | |
| heat color | 1.2 | 1.8 | 2.3 | 2.5 | 2.6 | |
| B. Cation exchanger + sulfonated coal + anion exchanger | | | | | | |
| original color | 0.3 | 0.3 | 0.3 | 0.4 | 0.4 | 0.5 |
| heat color | 0.5 | 0.6 | 0.7 | 0.7 | 0.8 | 0.9 |

As can be seen from the data, the process of the invention again resulted in greatly improved color, color stability and efficiency over the conventional process.

EXAMPLE III

In this example a syrup having a higher color than in the previous examples were refined in accordance with runs A and B of the previous examples. Both runs were conducted for 60 bed volumes. The original syrup had the following composition:

| | |
|---|---|
| Levulose | 42.5% |
| Dextrose | 53.0% |
| Maltose | 2.0% |
| Tri- and higher saccharides | 2.5% |
| Original color | 2.8 |
| Heat color | 9.6 |

The results are tabulated in Table III.

TABLE III

| After | 10 BV | 20 BV | 30 BV | 40 BV | 50 BV | 60 BV |
|---|---|---|---|---|---|---|
| A. (control) cation exchanger + anion exchanger + 1% active carbon | | | | | | |
| original color | 1.3 | 1.6 | 1.9 | 2.1 | 2.4 | 3.1 |
| heat color | 2.4 | 3.6 | 4.8 | 6.8 | 8.4 | 12.2 |
| B. cation exchanger sulfonated coal, anion exchanger MP62 | | | | | | |
| original color | 0.7 | 0.7 | 0.8 | 1.0 | 1.1 | 1.4 |
| heat color | 1.8 | 1.9 | 2.1 | 2.1 | 2.3 | 2.6 |

EXAMPLE IV

In this example a slightly different prior art refining process was used as the control (run A), which was as follows: the pH of the syrup was brought to 4.5, and the syrup was first treated by slurrying it with activated carbon, in an amount of 0.5%, at a temperature of 70° C for 20 minutes. The syrup was then sent through a strong acid cationic exchanger (Duolite C3, by Diamond Shamrock Co.) and finally through a weak based anion exchanger (Duolite A6, Diamond Shamrock Co.).

Run B, illustrating the invention was as in the previous examples. Run C, also illustrating the invention, was identical to Run B except the syrup was first treated by slurrying it with activated carbon, as in Run A, before it was passed over the cation resin (C16P). Samples of all three runs were analyzed after 10, 30 and 50 bed volumes.

The initial and refined syrup samples were tested for original color and heat color, as before, plus the following additional properties. (1) Clarity (measure of adsorbance at 600 mu on a Beckman mu), (2) ash, (3) protein (Kjeldahl method), (4) amino acids (determined by the ninhydrine method using a spectrophotometer at 570 mu), and (5) psicose (determined by the Technicon sugar chromotography system.)

The starting material was an enzymatically produced levulose syrup having the following composition:

| | |
|---|---|
| Levulose | 41% |
| Dextrose | 52% |
| Maltose | 2% |
| Tri- and higher saccharides | 5% |
| Original color | 8.4 |
| Clarity | 91 |
| Heat color | 24.3 |
| Ash | 0.20% |
| Protein | 0.188% |
| Amino acids | 59 ppm |
| Psicose | 0.33 |

The results are tabulated in table IV.

TABLE IV

| | A(Control) | B(Invention) | C(Invention) |
|---|---|---|---|
| After 10 BV | | | |
| Color | 0.4 | 0.4 | 0.0 |
| Clarity | 100 | 100 | 100.0 |
| Heat color test | 6.1 | 2.7 | 1.2 |
| Ash (%) | ±0 | ±0 | ±0 |
| Protein (%) | 0.03 | 0.04 | 0.01 |
| Amino acids (ppm) | 3.0 | 3.3 | 1.9 |
| After 30 BV | | | |
| Color | 3.0 | 0.8 | 0.0 |
| Clarity | 98 | 100 | 100.0 |
| Heat color test | 20.9 | 6.5 | 7.1 |
| Ash (%) | 0.06 | 0.04 | 0.04 |
| Protein (%) | 0.178 | 0.076 | 0.047 |
| Amino acids (ppm) | 59.6 | 4.2 | 3.7 |
| After 50 BV | | | |
| Color | 3.4 | 2.4 | 1.8 |
| Clarity | 98 | 100 | 100 |
| Heat color test | 22.7 | 13.3 | 13.6 |
| Ash (%) | 0.22 | 0.115 | 0.14 |
| Protein | 0.182 | 0.120 | 0.074 |
| Amino acids (ppm) | 65.8 | 13.4 | 7.0 |
| Psicose (%) | 0.35 | 0.33 | 0.33 |

As can be seen from the data in Table IV, after ten bed volumes there was no significant difference between the products refined by any of the processes, except the conventional process yielded a product having slightly inferior color stability. After 30 and 50 bed volumes, however, the differences are dramatic, particularly with respect to color and color stability and the removal of impurities such as amino acids. It will be also noted that no psicose was formed during any of the processes.

I claim:

1. Process for refining an enzymatically produced levulose-bearing syrup comprising subjecting said syrup to treatment with a cation exchanger and an anion exchanger for the removal of ions, and sulfonated coal for the removal of color bodies and color percursors.

2. The process of claim 1 wherein the cation exchanger is of a strongly acid type and the anion exchanger is of a weakly basic type.

3. The process of claim 1 wherein the syrup is treated first with the cation exchanger, second with the sulfonated coal, and third with the anion exchanger.

4. The process of claim 3 wherein the cation exchanger is of a strongly acid type and the anion exchanger is of weakly basic type.

5. The process of claim 1 wherein the sulfonated coal has been given decolorizing ability by first treating it with a strong alkali and then treating it with a strong acid.

6. The process of claim 1 including the additional step of further decolorizing the syrup with activated carbon.

7. The process of claim 6 wherein the activated carbon decolorization is the last step of the refining process.

8. A process for refining an enzymatically produced levulose-bearing syrup comprising subjecting said syrup first to the action of a strongly acid type cation exchanger, second to the action of sulfonated coal having decolorizing ability, and third to the action of a weakly basic type anion exchanger.

9. Process of claim 8 wherein the sulfonated coal has been given decolorizing ability by first treating it with a strong alkali and then treating it with a strong acid.

10. The process of claim 8 wherein, following the step of subjecting the syrup to treatment with the weakly basic anion exchanger the syrup is further decolorized with activated carbon.

* * * * *